United States Patent [19]

Plunkett

[11] Patent Number: 4,891,027

[45] Date of Patent: Jan. 2, 1990

[54] WATER SKI BINDING

[76] Inventor: Michael D. Plunkett, 5931 Bellfield, Huntington Beach, Calif. 92648

[21] Appl. No.: 351,252

[22] Filed: May 5, 1989

Related U.S. Application Data

[63] Continuation of Ser. No. 43,898, Apr. 29, 1987, abandoned.

[51] Int. Cl.[4] ..... A63C 9/00

[52] U.S. Cl. ..... 441/70; 441/68

[58] Field of Search ..... 441/68, 70; 280/11.31, 280/11.32, 11.33, 11.34, 611, 616, 618, 623, 625, 627–634

[56] References Cited

U.S. PATENT DOCUMENTS

| | | | |
|---|---|---|---|
| 3,750,204 | 8/1973 | Walter | 441/70 |
| 4,131,963 | 1/1979 | Johnson | 441/70 |
| 4,279,048 | 7/1981 | Bundschuh et al. | 441/70 |
| 4,642,060 | 2/1987 | Scheurer et al. | 441/70 |
| 4,673,365 | 6/1987 | Scheurer et al. | 441/70 |
| 4,758,191 | 7/1988 | Ackert et al. | 441/70 |
| 4,759,734 | 7/1988 | Scheurer et al. | 441/70 |

*Primary Examiner*—Sherman D. Basinger
*Assistant Examiner*—Stephen P. Avila
*Attorney, Agent, or Firm*—Nilsson, Robbins, Dalgarn, Berliner, Carson & Wurst

[57] ABSTRACT

A water ski binding includes: a flexible rear boot member for the rear part of the foot of the skier; a rear mounting structure for the boot member having wall surface structure which rises generally upwardly with respect to the top surface of the ski; and another rear mounting structure for the boot member, also having wall surface structure which rises generally upwardly with respect to the top surface of the ski, which slides relative to the first mounting structure in order to press the boot member between such wall surface structures and mount the boot member on the ski. The second mounting structure is formed to support the heel of the skier and the flexible boot member is formed to be held in position substantially solely through abutting wall surfaces of the mounting structures and boot member. The water ski binding also includes: a front boot member mounting structure defining an elongated opening which extends, along it direction of elongation, generally along the length of the ski; and a front boot member for the front part of the foot of the skier, having elongated wall structure which is adapted to be slidably inserted, along its direction of elongation, in such opening, to mount the boot member on the ski. This mounting structure is formed to support the forefoot of the skier and the boot member is formed to be held in position, when mounted, substantially solely through abutting wall structures of the mounting structure and boot member. The water ski binding also includes a base structure and a locking and unlocking mechanism to selectively lock the front mounting structure, and the front boot member therein, in alternative positions generally along the length of the ski.

33 Claims, 6 Drawing Sheets

FIG. 4
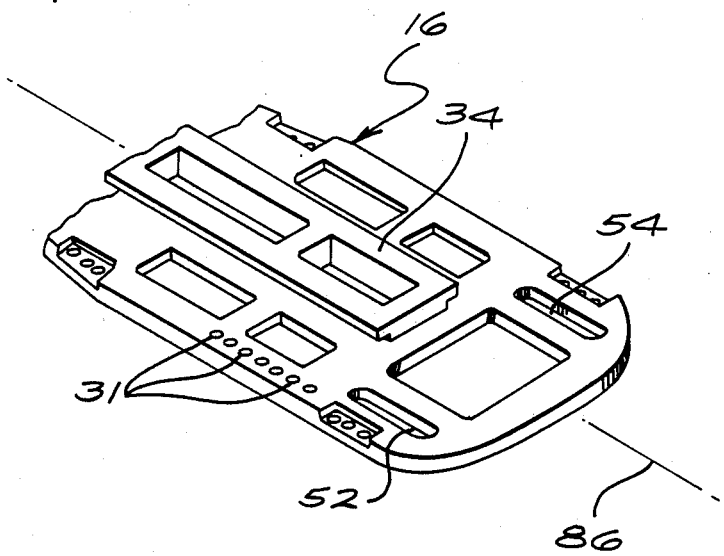
FIG. 5
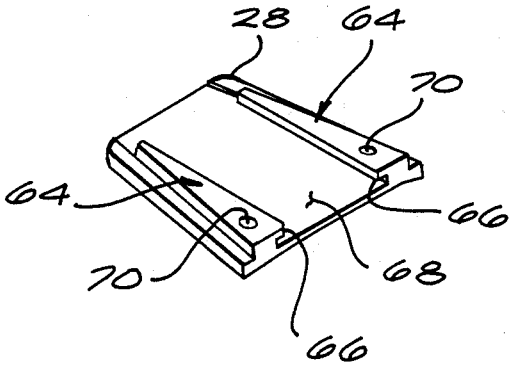
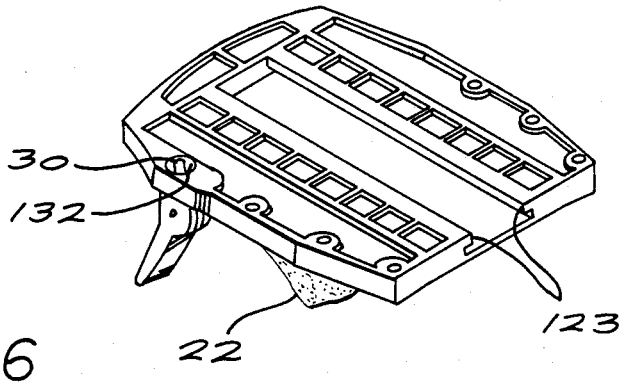
FIG. 6

FIG. 11A
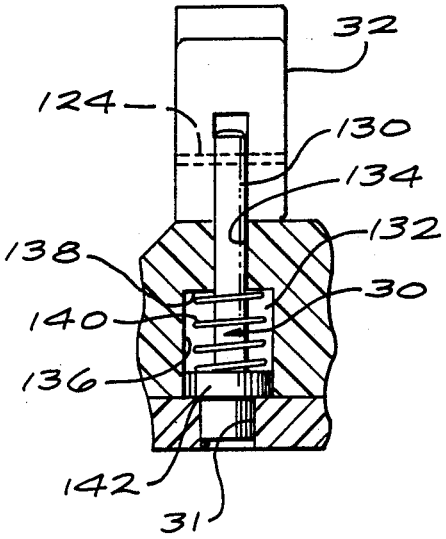
FIG. 11B
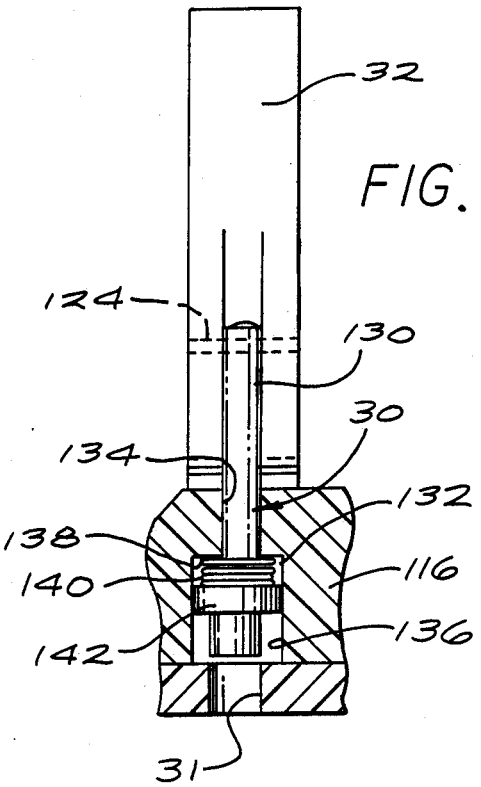
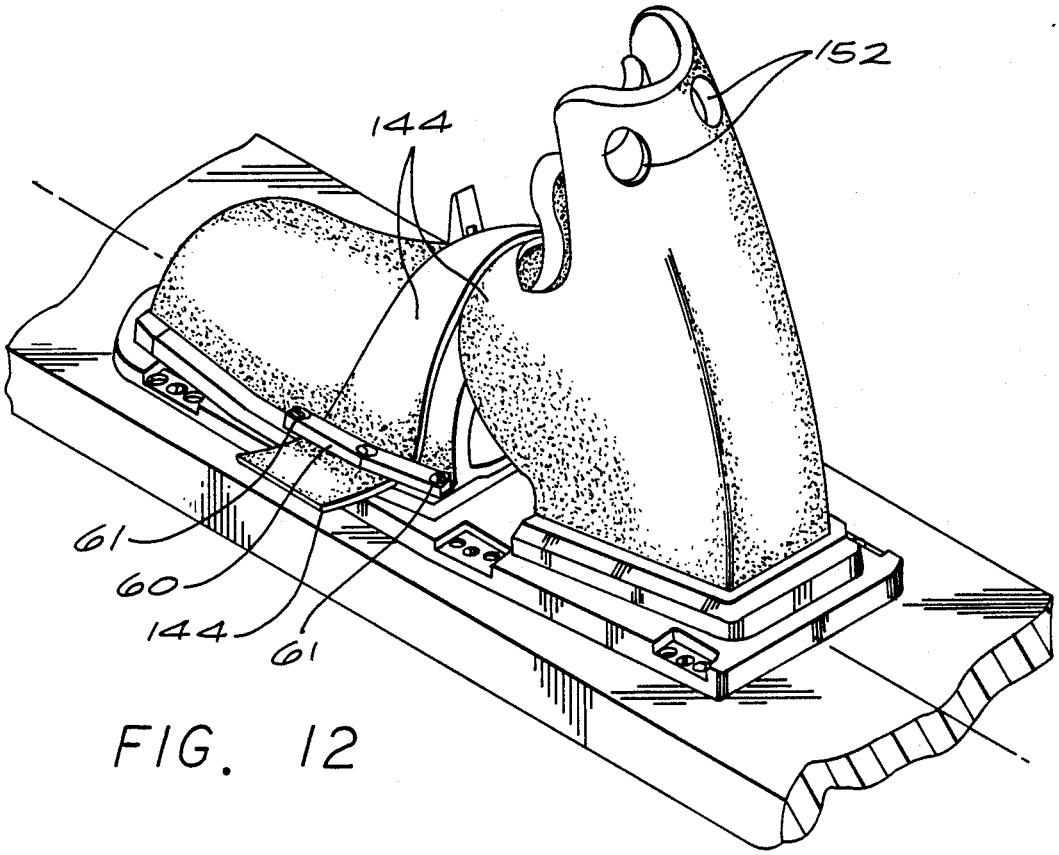
FIG. 12

WATER SKI BINDING

This is a continuation of co-pending application Ser. No. 07/043,898 filed on Apr. 29, 1987 now abandoned.

FIELD OF THE INVENTION

This invention pertains to the field of water ski bindings.

BACKGROUND OF THE INVENTION

Water ski bindings historically have been a substantial source of challenge for those attempting to satisfy and balance the desired characteristics for such bindings. Of course, safety is a prime consideration. The binding is a focal point for the interaction between the skier and the ski, often while travelling at a relatively high speed. Thus, the binding must be extremely sturdy. In addition, certain forms of bindings should release the skier from the ski at appropriate times (but not release the skier at inappropriate times).

Size adjustment, so one binding can readily serve widely varied foot sizes, is another desired characteristic which presents its own challenges, particularly in light of the other desired properties.

Complexity of construction and/or assembly are quite typical in water ski bindings as well as excessive wear and fatigue of the pliable foot-holding pieces.

It is now commonplace for a water ski binding to incorporate front mounting apparatus which is movable along the ski, for pliable material to hold the forward part of the foot of the skier. Alternatively, and perhaps more typically, the rear mounting apparatus, for the pliable material to hold the rear part of the foot, is movable.

Quite typically, at the rear, a horseshoe-type mounting configuration is employed in which the pliable material is extended generally horizontally into a slot or space. Typically, screws or connectors pass through the material to hold it in place. Calapp et al., U.S. Pat. No. 4,494,939 is a variation of this.

The Calapp et al. patent also incorporates a movable rear mounting for adjustment purposes. A pair of posts are screwed into the ski on either side. A pair of cams, connected to the posts, press against detents along a heel mounting piece to press the piece down against springs acting against projections on the posts and the underside of the heel piece. Turning the cams permits the heel piece to rise, urged by the springs, for adjustment along the ski.

Another form of binding, movable at the rear, incorporates elongated openings on both sides for large threaded screw members. The openings are shaped so that the screw member heads or structures near such heads will lock the mounting, when screwed down, in a selected one of a variety of positions for the openings along the screw members.

With regard to holding the pliable material at the rear, it is also rather typical to provide a heel plate with holes along and into its outside vertical surfaces. Then the material, simply, can be held to the heel plate along that wall by passing screws through the material into the holes. Mounting structure, of course, can also readily be employed over the pliable material with the screws passing therethrough before entering the material and the heel plate.

Concerning the pliable material for the forward part of the foot and mounting apparatus therefor, the horseshoe-type configuration already discussed is also readily employed, except an open toe, at the front, is extremely common so that the specific horseshoe shape, in such case, would not apply. However, the generally horizontal slot with the material inserted adopts the same principle.

Another form, at the front, has the pliable material along the side of a mounting plate structure and also extending underneath the plate structure. Underneath, the plate structure is provided with shaped, rather long grooves; and the pliable material is also shaped to mate with the form of the grooves. Connectors from the underside of the plate structure pass through holes along portions of the pliable material under the plate structure. Such holes can be stretched over enlarged tops for the projections which then serve to hold the material.

Concerning this form, and movability at the front, the described projections can slide along openings running along the sides of a foundation plate. An array of small openings running along the center of the foundation plate, then, is employed to lock the mounting plate in selected positions. The mounting plate incorporates a thin elongated structure, on the underside of the plate, attached at only one end of such structure. A rotatable cam, under the thin structure, then is turned to bend the structure downward and insert projections on the structure into mating openings of the foundation plate array of openings. Turning the cam further allows the structure to unbend, removing the projections from the openings and freeing the mounting plate for adjustment and re-locking, by a further turning of the cam.

Another form, movable at the front, adopts a foundation plate with a track and a mounting piece for the flexible material on the track. The foundation plate, along one side, is provided with an elongated structure having a series of transverse slots, each slot providing a different position adjustment. To lock the mounting piece, with the flexible material thereon, a locking member is rotatably mounted along the mounting piece and has a mating structure for the slots which can be rotated into a slot or rotated in the other direction out of the slot. A thin plastic projection of the member acts against the structure in which the transverse slots are present to hold the mating structure in a slot and to resist the rotation out of the slot.

The above description and forms exemplify the challenge and difficulty in achieving safety, durability and simplicity of use and construction in water ski bindings. The present subject matter addresses these concerns in a comprehensive, integrated manner.

SUMMARY OF THE INVENTION

In accordance with the invention, a water ski binding includes: a flexible boot member for the foot of the skier; a first boot member mounting structure having wall surface structure to rise generally upwardly with respect to the top surface of the ski; and a second boot member mounting structure, having wall surface structure to rise generally upwardly with respect to the top surface of the ski, to slide relative to the first mounting structure and press the boot member between the wall surface structures to mount the boot member on the ski.

Such wall structure of one of the boot member mounting structures includes a first portion to face generally inwardly and extend generally along the length of the ski toward one side of the ski, a second portion to face generally inwardly and extend generally along the length of the ski toward the other side of the ski and a third portion to face generally inwardly and extend generally along the width of the ski. Such wall structure of the other one of the boot member mounting structures then includes a first portion to face generally outwardly and extend generally along the length of the ski toward one side of the ski, a second portion to face generally outwardly and extend generally along the length of the ski toward the other side of the ski and a third portion to face generally outwardly and extend generally along the width of the ski.

The second mounting structure is formed to support the heel of the skier; and the flexible boot member is formed for the heel of the skier. The boot member has wall structure including rise portions to rise generally upwardly with respect to the top surface of the ski for abutment with the described boot member wall surface structures, and also flange portions to extend under one of the mounting structures. The flexible boot member is formed to be held in position, when mounted, substantially solely through abutting wall surfaces of the mounting structures and of the member.

In accordance with other aspects of the invention, a water ski binding includes: a boot member mounting structure defining an elongated opening to extend, along its direction of elongation, generally along the length of the ski; and a flexible boot member for the foot of the skier, having elongated wall structure for slideable insertion, along its direction of elongation, in such opening to mount the boot member on the ski.

The elongated mounting structure opening and elongated boot member wall structure are generally T-shaped; and the mounting structure also includes a bar structure to mount across the entrance of the elongated opening.

This boot member mounting structure is formed to support the forefoot of the skier and this boot member is flexible and formed for the forefoot of the skier. This boot member, also, is formed to be held in position, when mounted, substantially solely through abutting wall structures of the boot member and boot member mounting structure.

In accordance with yet further aspects of the invention, a water ski binding includes: a base structure to mount on the top surface of the water ski defining a series of openings in a line to extend generally along the length of the ski; a flexible boot member for the foot of the skier; a boot member mounting structure to movably mount on the base structure for mounting the flexible boot member, having an elongated opening therethrough to extend, along its direction of elongation, generally vertically with respect to the top surface of the ski; and locking and unlocking apparatus to selectively lock the boot member mounting structure in alternative positions generally along the length of the ski defined by the series of openings and unlock the boot member mounting structure from such positions. This locking and unlocking apparatus then includes an elongated pin member to extend along the described elongated opening for extension into a selected opening of the series of base structure openings to accomplish such a locking and retraction from the opening to accomplish such an unlocking.

The locking and unlocking apparatus also includes a cam member rotatably mounted on the pin member to act against the described mounting structure, to accomplish the extension and retraction of the pin member, along with a spring member about the pin member to oppose such retraction with rotation of the cam member in one direction and to urge such extension with rotation of the cam member in the other direction.

The pin member includes a flange and the wall of the elongated opening for the pin member defines a shoulder to face generally downwardly with respect to the top surface of the ski. The spring member then acts against the flange and the shoulder.

In a water ski binding embodiment, in accordance with the above and with further aspects of the invention, a base structure is provided with a track structure and the rear boot member mounting structure serving as a heel support and the front boot member mounting structure are provided with openings to slideably mount them on the base structure. There are also, for the front mounting structure and the front boot member a pair of generally T-shaped elongated openings and elongated wall structures, one along each side. The described bar structure then is employed for mounting across the entrance of both of the elongated front mounting structure openings. This bar structure, then, also incorporates a pair of projections which, with the bar structure mounted, project generally downwardly with respect to the top surface of the ski, each into an elongated opening along the base structure. As a safety mechanism, this projection-slot arrangement will maintain the front mounting structure, with the front flexible boot member therein, on the ski in the event the locking and unlocking apparatus, as described, and as provided on the front mounting structure, for some reason fails.

BRIEF DESCRIPTION OF THE DRAWINGS

FIG. 4 is a perspective view, partially broken away, showing the front of a component of the water ski binding which is shown at the rear in FIG. 2.

FIG. 5 is a perspective view showing the underside of a component of the water ski binding which is shown from the top side in FIG. 2.

FIG. 6 is a perspective view showing the bottom of another component of the water ski binding which is shown from the top in FIG. 2.

FIGS. 11A and 11B are cross-sectional views, partially broken away, taken along the line 11—11 of FIG. 1, showing the locking mechanism of the front part of the binding in a locked and unlocked configuration.

FIG. 12 is the perspective view of FIG. 1 showing alternative components along with the unchanged components.

DETAILED DESCRIPTION

Figure 1:
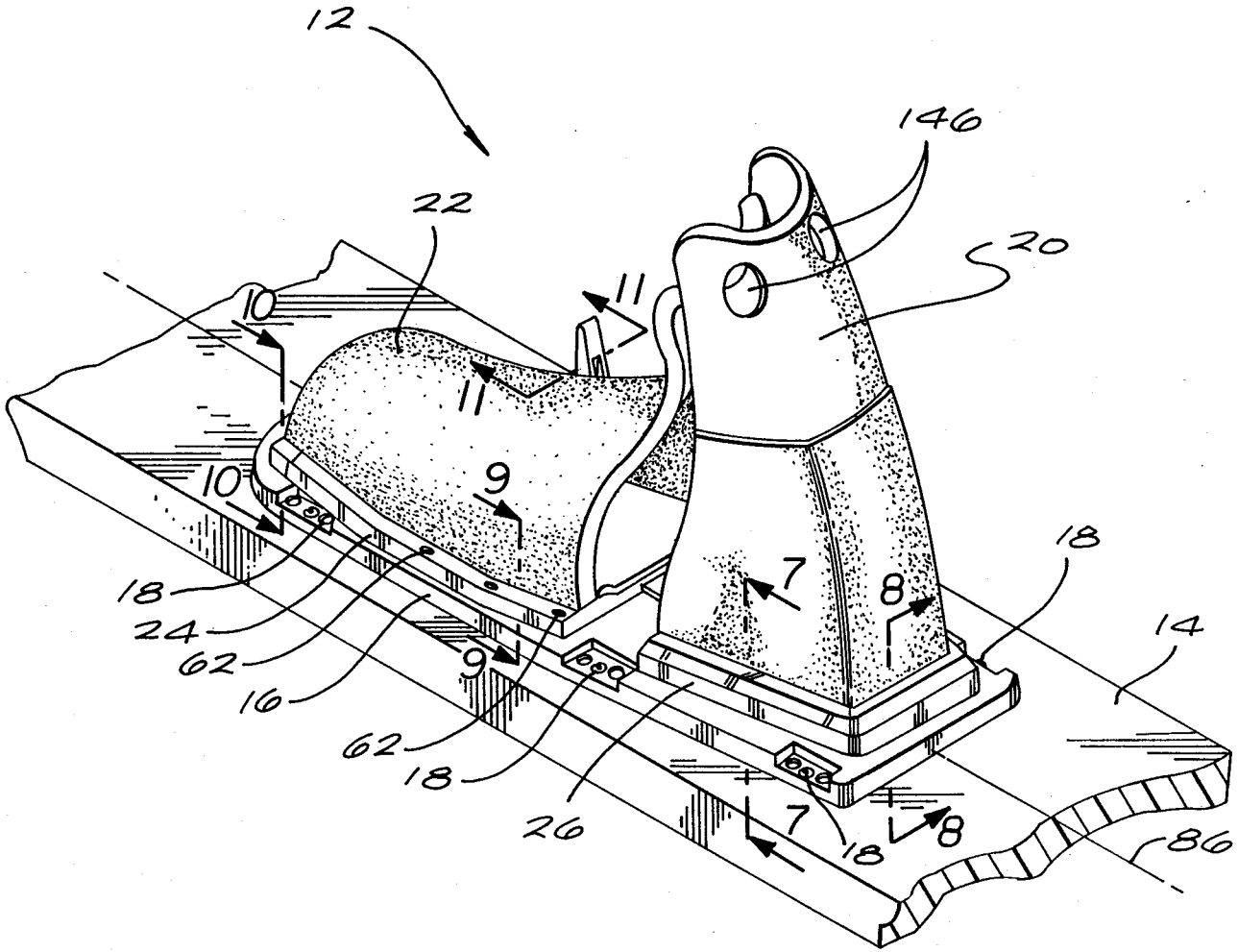
FIG. 1 is a perspective view of a water ski binding in accordance with the invention mounted on a water ski (broken away).

Referring to FIG. 1, and by way of introduction, there is shown a water ski binding 12 in accordance with the invention mounted on a water ski 14 (shown broken away). The water ski binding includes a base structure 16 held to the ski by passing screws 18 through holes in the base structure and into the ski, a rear flexible boot member 20 and a front flexible boot member 22. The water ski binding also incorporates a front mounting structure 24 for the front boot member 22, which is slideably mounted for position adjustment, a ridge structure 26 and a heel piece 28 (FIG. 2) which act as rear mounting structures for the rear boot member, and a locking and unlocking mechanism for the positioning of the front mounting structure. The locking and unlocking mechanism operates through the extension and retraction of a pin member 30 into and out of a series of position openings 31 along one side of the base structure 16 (FIG. 4). The extension and retraction is achieved through the action of a cam member 32 against the front mounting structure 24.

Figure 2:
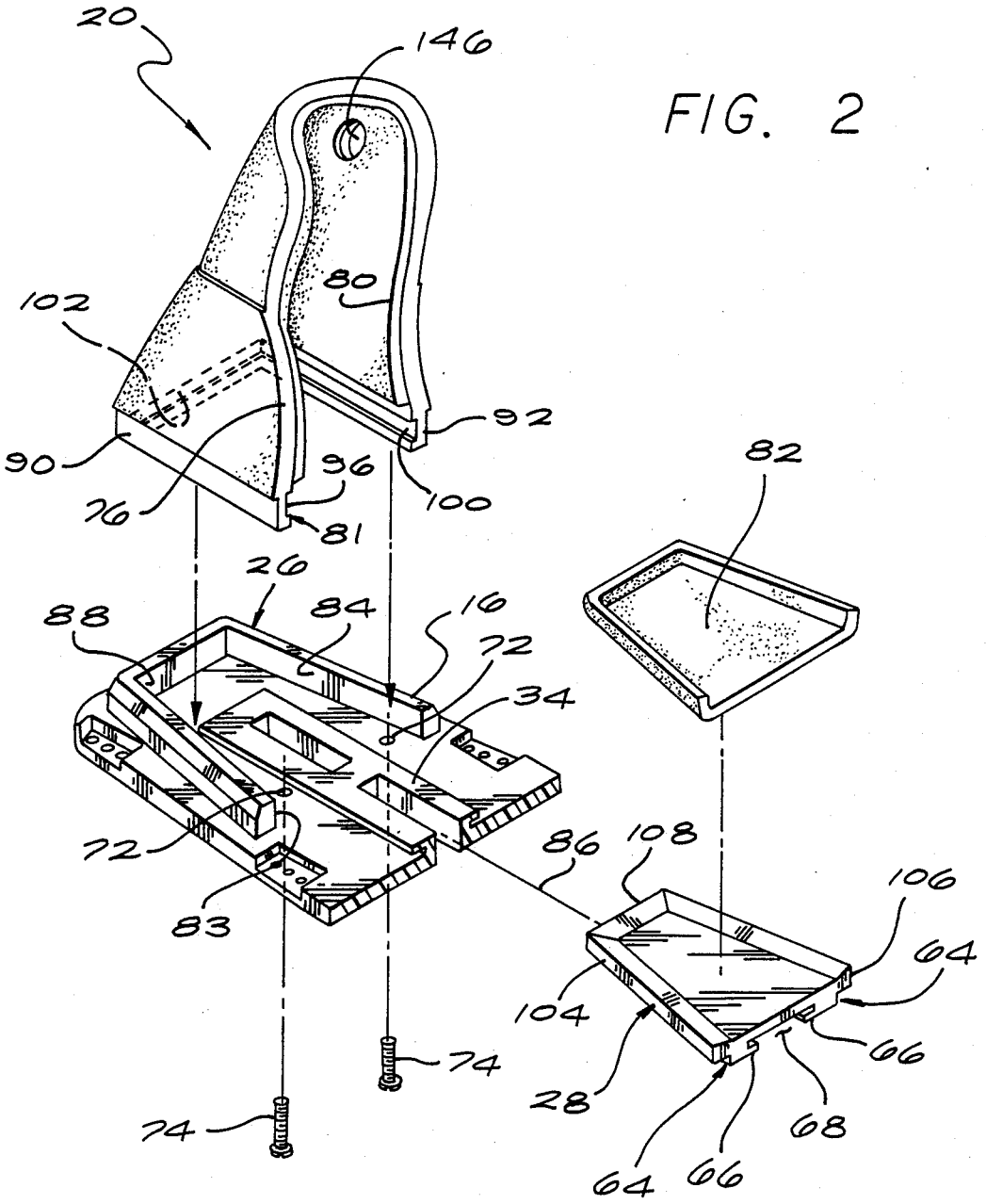
FIG. 2 is an exploded perspective view, partially broken away, of components of the water ski binding of FIG. 1 at the rear of the binding.
Figure 3:
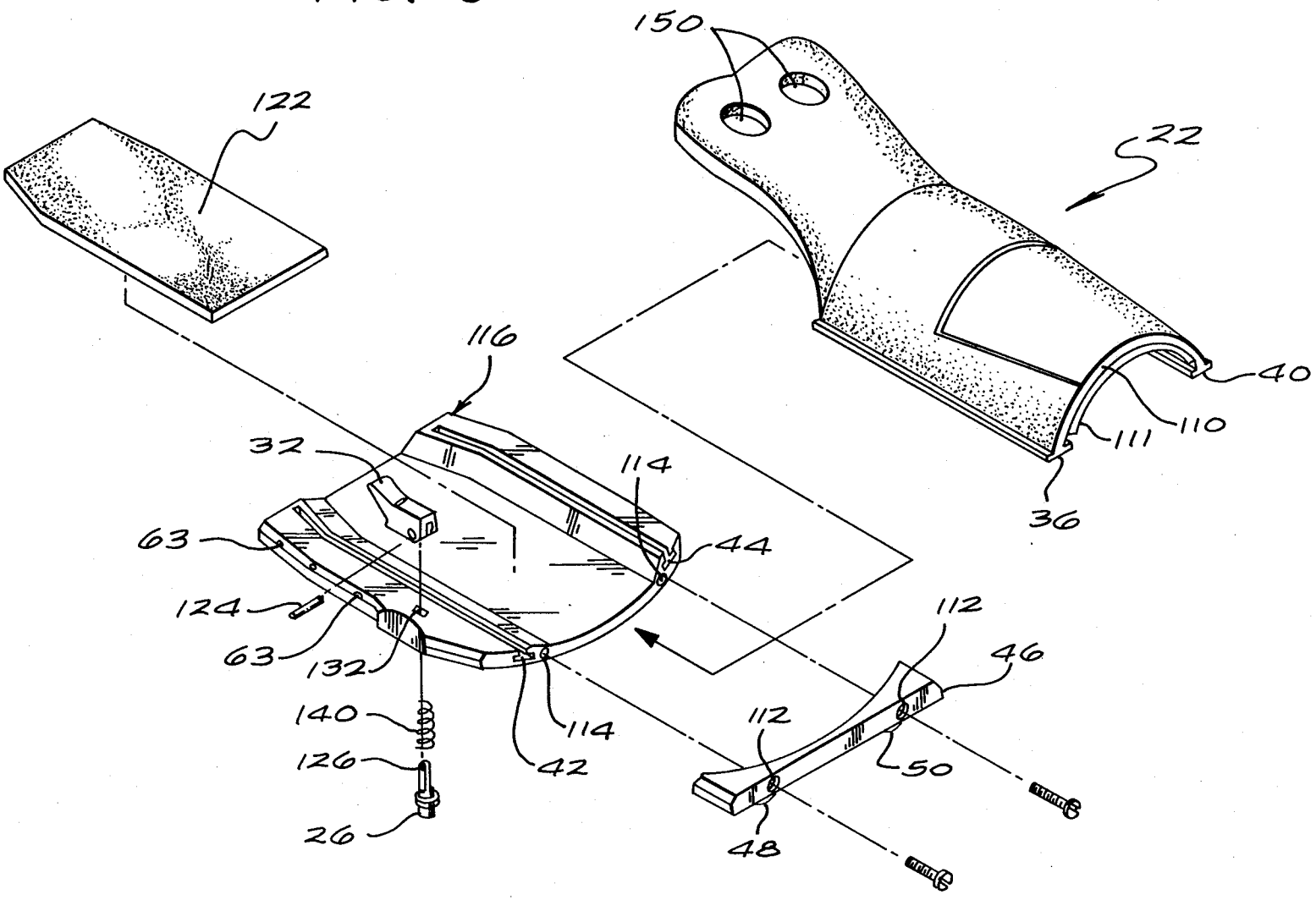
FIG. 3 is an exploded perspective view of certain components of the binding of FIG. 1 at the front of the binding.
Figure 7:
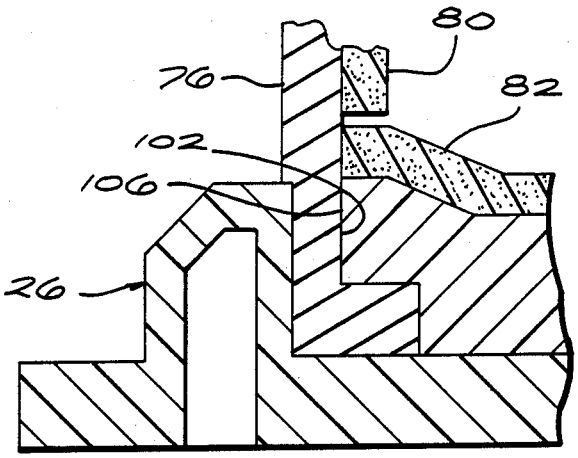
FIG. 7 is a cross-sectional view, partially broken away, taken along the line 7—7 of FIG. 1.
Figure 8:
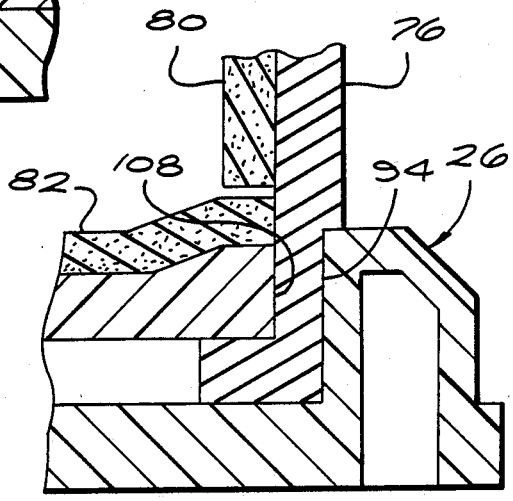
FIG. 8 is a cross-sectional view, partially broken away, taken along the line 8—8 of FIG. 1.

The mounting of the rear boot member 20 is accomplished in extremely convenient, effective and sturdy fashion by sliding the heel piece 28 along a track structure 34 which is on the base structure 16 so that wall structure of the boot member is pressed between the heel piece and the ridge structure 26 and so that additional wall structure of the member is under the heel piece (FIGS. 2, 7 and 8). The front boot member 22 is mounted on the front mounting structure 24 in similarly convenient, effective and sturdy fashion. This is achieved, in that case, by slideably inserting left and right (with reference to the view of the binding from the front) substantially T-shaped wall structures 36 and 40 into mating left and right openings 42 and 44 along the sides of the front mounting structure 24 (FIG. 3). These openings, then, are also substantially T-shaped. A front mounting bar 46, incorporated into the front mounting structure, then covers the entrances of the openings after the slideable insertion of the front flexible boot member 22 (FIG. 3). This front mounting bar also acts as a safety stop in the event of failure, for some reason, of the locking mechanism for the front mounting structure. Generally cylindrically-shaped left and right projections 48 and 50 of the bar from the underside fit into left and right elongated slots 52 and 54 through the base structure 16. In the event of such failure, the projections will then slide into the front walls of the slots and maintain the front mounting structure, with the front flexible boot member therein, mounted on the base structure. This provides a substantial added element of safety.

With the substitution of an alternative, strapped rear flexible boot member 56, and the use of a pair of strap bars 60, over the ends of the straps, mounted with screws 61 screwed into holes 62 and 63 along the right side and along the left side of the front mounting structure (viewing the binding from the front), and with the remainder of the ski binding being essentially unchanged, the binding is transformed into one in which the foot of the skier is tightly strapped in. One strap end, one strap bar 60 and one pair of mounting screws 61, on one side, are shown in FIG. 12; however, as is clearly evident, the structure with regard to such elements at the other side is essentially symmetrical in FIG. 12. In this altered form, the binding is adapted for advanced or expert skiers. (The straps, of course, with the skier's foot in the binding, pass tightly over the top of the front flexible boot member 22.) To avoid passing screws through the straps, and thus weakening the straps, the center openings of the strap bars are not used. However, if the particular skier so desires, he may employ the center openings, thus puncturing the straps with screws at these single positions.

Now turning to various of the matters already referred to, in additional detail, and to additional aspects, in assembly the heel piece 28 is placed on the track structure 34 from the front of the structure (FIG. 4). The track structure is conveniently formed integrally with the base structure 16. The heel piece, as is shown, is formed with a pair of generally wedge-shaped projections 64 along the underside thereof. These projections, including flange structures 66 therealong, to fit over the track structure, with the main body of the heel piece, define an opening 68 along the heel piece for the slideable mounting of the heel piece on the track structure. (The portions of the opening under the projections are essentially of unchanging width along the full length thereof with the side walls of the projections becoming thinner toward the rear.) The wedge-shaped projections have a pair of alignment openings 70 into the undersides thereof. With the flexible rear boot member in position and the heel piece 28 slid into position tightly pressing the heel piece against the ridge structure 26, these heel piece alignment openings will be aligned with a mating pair of base structure alignment openings 72 through the base structure. Then a pair of threaded screws 74 can be passed through the base structure alignment openings and screwed into the threaded heel piece alignment openings to hold the heel piece tightly in position. The heel piece, of course, is formed to support the heel of the water skier while also acting as a mounting structure for the rear boot member.

The basic, flexible rear boot member 20 is made of a relatively tough and dense, but flexible outer wall structure 76 which is rubber-like material and which can readily be formed from a synthetic rubber. An inside layer 80 is less tough and less dense to conform to the rear portion of the foot and the lower leg of the water skier when against it. It also is rubber-like and is conveniently formed of a foamed synthetic rubber material. As is readily apparent in FIGS. 2, 7 and 8, the inside layer ends below the bottom of the outside layer to, with flange structure of the outside layer, form a slot 81 around the inside of the boot member for the heel piece 28. The slot which, as with the rear boot member, has essentially two symmetrical halves, is well evident in these figures.

For purposes of comfort and conformity to the heel of the skier, a relatively soft flexible (pliable) pad 82 is bonded to the upper surface of the heel piece 28. This is conveniently of the same general type of material as for the inner layer 80 of the front boot member 22. Typically, however, it is somewhat softer since the foot rests directly on this rather than merely against it.

The ridge structure 26, which conveniently is integrally formed with the base structure 16, as indicated, acts as a mounting structure in cooperation with the heel piece 28 for the rear boot member 20. With reference to the view from the front, the ridge structure has a left wall surface portion 83 which faces inwardly, on the base structure and on the ski, and which, positioned toward the left side of the ski and base structure, extends along the length of the base structure and ski. Then there is a corresponding right wall surface portion 84 (essentially symmetrical with the left wall surface portion) which faces inwardly, is positioned toward the right side, and which extends along the length of the base structure and ski. These surface portions are angled slightly outwardly toward the front with respect to the centerline 86 of the base structure 16 and of the ski. This angle, of course, can be varied; however, an angle of approximately 10° has been found convenient and effective. There is then also a rear wall surface portion 88 of the ridge structure which faces inwardly from the rear and which runs along the width of the base structure and of the ski—and, in fact, substantially perpendicularly to the referenced centerline 86. These surface portions, of course, rise upwardly with respect to the base structure and ski—and, in fact, substantially directly vertically (perpendicularly). With the rear boot member 20 mounted in position, these wall surface portions abut corresponding left 90, right 92 and rear 94 wall surface portions along the lower outside of the boot member. The left 96, right 100 and rear 102 inside wall surface portions for the slot 81 formed by the boot member, with the heel piece 28 and boot member in position, then respectively abut left 104, right 106 and rear 108 wall surface portions of the heel piece 28.

As is well evident, with the heel piece 28 in position, its left wall surface portion 104 faces outwardly, on the base structure 16 and ski, and, positioned toward the left side of the base structure 16 and ski, runs along the length of the ski. It also rises upwardly with respect to the base structure and ski—and, in fact, substantially directly vertically (perpendicularly). The right portion 106 has these same characteristics; however, it, of course, is positioned toward the right side. To match the angles of the described left and right wall surface portions of the ridge structure 26, facing inwardly, at the left and right, these left and right heel piece surface portions are angled with respect to the midline 86 of the base structure and of the ski, at the same angle. Again, an angle of about 10° has been found convenient and effective.

By reference to the above description and the drawings, it is evident that the rear boot member 20, through the mounting structure, is held in position on the base structure, and thus on the ski, substantially solely through abutting wall surfaces of the member, the heel piece 28 and the ridge structure 26. This provides great ease and convenience of assembly and use, great sturdiness and safety, and acts to minimize wear on the flexible boot member.

Figure 9:
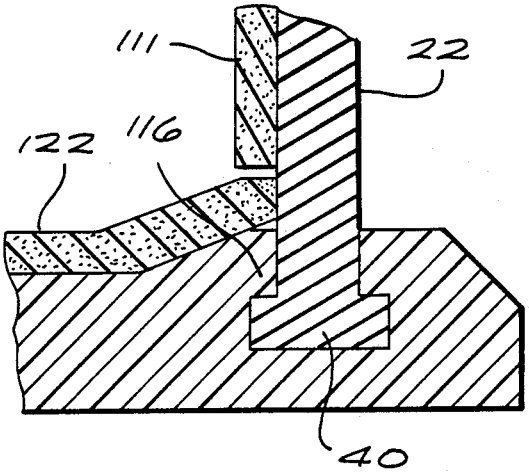
FIG. 9 is a cross-sectional view, partially broken away, taken along the line 9—9 of FIG. 1.
Figure 10:
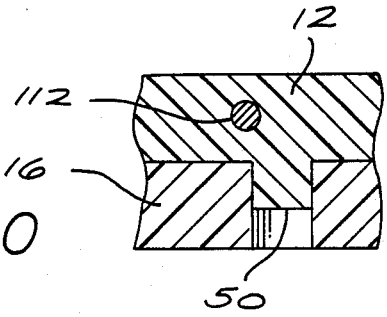
FIG. 10 is a cross-sectional view, partially broken away, taken along the line 10—10 of FIG. 1.

Now, with respect to the mounting and boot member at the front, the mounting of the front boot member 22 on the front mounting structure 24 and of the front mounting structure on the base structure 16 is well evident from the prior description, in connection with the drawings. Concerning some of the additional detailed aspects, the front boot member 22 has a relatively tough and dense, flexible (pliable) outer layer 110 and a softer, less dense and tough, flexible inner layer 111, of the same respective materials as for the rear boot member 20. As shown in FIG. 3, the inner layer, of course, does not extend down to the T-shaped portions which are inserted in the left and right mounting structure openings 42 and 44 for the T-shaped portions. This insertion is achieved in tightly-fitting fashion by applying a standard lubricating substance in the openings and along these T-shaped portions before such insertion. The openings, of course, run, along their directions of elongation, along the length of the mounting structure 16 and of the ski. Front and rear portions of the openings are angled slightly with respect to the midline 86 (FIG. 1) of the mounting structure and of the ski. The middle portions are substantially parallel to such midline. Employing angled portions is convenient can be effective, although angles, of course, can readily be varied. An angle for the front portions of about 2°–3° and for the rear portions of about 6°–7° has been found to be favorable. The front portions are angled inwardly toward the front and the rear portions are angled outwardly toward the front. After the front boot member 22 is inserted, the front mounting bar 46 is incorporated into the front mounting structure by passing threaded screws through openings 112 therethrough, into aligned threaded openings 114 in the front of the main portion 116 of the front mounting structure. The elongated openings 42 and 44, of course, end short of the rear end of the main portion 116 of the front mounting structure and their end walls act as stops for the inserted T-shaped wall structures 36 and 40 of the front boot member. The cross-sectional view of FIG. 9 is illustrative in showing the abutting wall structures of the T-shaped elongated openings and of the T-shaped portions of the boot member with the member in mounted position.

The front mounting structure 24, of course, acts to support the forefoot (front portion of the foot) of the skier. Thus, for purposes of comfort and conformity to the foot of the skier, a relatively soft flexible (pliable) pad 122 is bonded to the upper surface of the structure. This is conveniently of the same general type of material as for the inner layers of the boot members. Typically, however, it is somewhat softer since the foot rests directly on this rather than merely against it.

In slideably mounting the front mounting structure 24 on the track structure 34, an opening along the bottom of the main portion 116 of the front mounting structure is employed. As shown in FIG. 6, elongated flange structures 123 are used in defining the shape of the opening and to hold the mounting structure on the track.

The front mounting structure 24, of course, is slideably mounted not only to assemble the ski binding but to slideably adjust its position, and the position of the front flexible boot member 22 therein, for different sizes of feet. The locking and unlocking mechanism for establishing and holding such an adjusted position and for unlocking from the position for readjustment has already been addressed in some detail. Concerning this mechanism and the aspects directly associated with it, the series of position openings 31 for the pin member 30 of the locking mechanism runs in a straight line along the length of the base structure 16 and of the ski—and, in fact, essentially directly parallel to the midline 86 of the base structure and ski. Although seven openings, as shown, are convenient and appropriate, the number can be readily varied according to particular requirements. These openings, in the embodiment, pass completely through the base structure although this, of course, is not necessary.

Several basic aspects of the locking mechanism should be specifically mentioned. First, the mechanism is advantageously simple to assemble and operate, including the existence of a single mechanism on only one side of the binding. Also, achieving the locking and unlocking by the pin movement is extremely advantageous and convenient. Also, the fact that the force of the spring urges the pin member into a locked position is considered advantageous and a meaningful element of safety.

The cam member 32 is rotatably mounted on the pin member by press-fitting a rod-like element 124 through openings on either side of the cam member while it also passes through an opening 126 toward the top of the pin member. The pin member 30 has its barrel, which is round-shaped near the bottom of the pin member, squared off along two sides along a substantial portion of the barrel from the top down. These squared-off sides 130 are shown in FIGS. 11A and 11B (see also FIG. 3). In this connection, the elongated mounting opening 132 through the main portion 116 of the front mounting structure 24, has a rectangular-shaped top portion 134 above its circular-shaped lower portion 136 (FIGS. 11A, 11B, 3 and 6). This elongated opening, of course, along its direction of elongation, is essentially directly vertical with respect to the base structure 16 of the binding and the top of the ski (perpendicular thereto). Where these two shapes along the opening come together, a shoulder 138 is formed. The spring 140 of the locking mechanism then conveniently, at one end, acts against this shoulder. At the other end, it acts against a circular flange structure 142 of the pin member. The rectangular shape of the upper portion of the mounting opening for the pin member, in connection with the shape of the upper portion of the pin, keeps the cam member 32 from rotating about the axis of the pin member and, thus, from turning so that it extends outwardly to be, perhaps, readily broken or to serve as a source of injury. As is readily apparent by reference to FIGS. 3 and 11A and 11B, the cam member 32 is rotated forward, acting against the top of the mounting structure to retract the pin member from a position opening 31. The locking mechanism, with the cam member 32 rotated forward, is shown in FIG. 11B. The cam member is then rotated backward to extend the pin member into a position opening 31. An extended, locked position for the locking mechanism with the cam member rotated backward, is shown in FIG. 11A.

As already explained, the alternate, strapped rear boot member 56, with its pair of strap bars 60 screwed into the main portion 116 of the mounting structure, can be substituted for the other rear mounting structure 20 which is adapted for more common use. The strapped member is adapted for advanced or expert water skiers who are more concerned with maintaining themselves in the binding under extreme conditions than having the binding pull off them to avoid injury when difficulties arise. Again, this strapped boot member is used with the same front boot member 22, with the straps running across the front boot member. Also, as also already indicated, the remainder of the ski binding, apart from the rear boot member and the two screwed-down strap bars 60 is essentially unchanged. The strapped rear boot member 56, itself, apart from the straps 144, is essentially identical to the other boot member 20. The straps conveniently are of the same material and, in fact, are simply integral extensions of, the outer layer material, as described in connection with the other boot member. Of course, an inner layer of material bonded to the outer layer could also readily be provided. As previously indicated, it is convenient and advantageous not to have bar mounting screws in the center openings of the strap bars 60 and, thus, not to have any screws passing through the straps. However, as also previously noted, some users may elect to employ such center screws. Each of the essentially identical strap bars (one shown) has a narrow slightly raised ridge generally along the center of the underside thereof (not shown) to dig into the strap for holding purposes.

So far as the material of the base structure 16, the ridge structure 26 and track structure 34 integrally formed thereon, the heel piece 28, the front mounting structure 24 and the cam member 32 are concerned, although a variety of materials can readily be employed, a fiber-filled nylon (polyamide) material is extremely effective and convenient,—for example 30% fiber-filled. These components can then largely be molded with a relatively small amount of finishing work being required to reach their final forms.

Several final matters are perhaps worthy of mention. First, to provide a degree of added stiffness along portions of the boot members where and near where they abut various of the mounting structures, fiber reinforcement is conveniently provided, embedded along the outer layers. The use of fiber reinforcement in structures of this type, of course, is familiar and well understood by those knowledgeable in the art. The flexible boot member material for such portions or parts of such portions can also, for example, be made somewhat more dense and tough than other portions of the outer layer material for the boot members to aid in the mounting of the boot members. For example, this can readily be accomplished in accordance with standard synthetic rubber formation techniques. It is also possible, for example, to embed into the elongated substantially T-shaped wall structures 36 and 40 of the front boot member 22 extremely thin, flat elongated metallic strips along part or all of the length of these wall structures—within and with the flat surfaces of the strips substantially parallel to the "crosses" of the T-shaped structures. Such strips would of course reinforce the resistance provided by the flexible T-shaped wall structures against pulling out of the T-shaped elongated openings for them, under unforeseen circumstances. Additional resistance, of course, could simply, alternatively be provided, for example, by passing (screwing) a screw into the side of the main portion 116 of the front mounting structure 24 from the outside, through the T-shaped wall structure into structure of such main portion on the other side of such T-shaped wall structure. For example, one screw could be used for each of the two T-shaped wall structures, on the side of such main portion for that structure, employed toward the rear of such main portion, with its barrel substantially horizontal (e.g., with reference to the view of FIG. 9) and passing through the part of the T-shaped structure just above the "cross" of the "T", which part, during assembly, is slid into the elongated opening for the wall structure. The use of such screws, as is evident, would, however, give rise to a requirement to puncture the front boot members with a screw on each side.

Concerning other aspects of these final matters, it of course is evident that finger holes, near the tops of the boot members, as shown in the drawings, are incorporated to help with the insertion of the foot of the skier into the boot members. Such openings 146 through the basic rear boot member 20, such openings 150 through the front boot member 22, and such openings 152 through the strapped boot member can be seen, for example, in FIGS. 1, 3 and 12, respectively. Also, it should of course be well evident that the very same water ski binding structure is adapted for use for the left and right foot of a water skier.

It will be evident to those familiar with the art that many changes and modifications may be made in the embodiments which have been described in detail without departing from the scope or spirit of the invention.

What is claimed is:

1. A water ski binding comprising:

a flexible boot member for the foot of the skier;

a first boot member mounting structure having wall surface structure to rise generally upwardly with respect to the top surface of the ski; and a second boot member mounting structure, having wall surface structure to rise generally upwardly with respect to the top surface of the ski, to press said boot member between said wall surface structures by slidable movement relative to said first mounting structure, to mount said boot member on the ski;

said wall structure of one of said boot member mounting structures including a first portion to face generally inwardly and extend generally along the length of the ski toward one side of the ski, a second portion to face generally inwardly and extend generally along the length of the ski toward the other side of the ski and a third portion to face generally inwardly and extend generally along the width of the ski; and said wall structure of said other one of said boot member mounting structures including a first portion to face generally outwardly and extend generally along the length of the ski toward one side of the ski, a second portion to face generally outwardly and extend generally along the length of the ski toward the other side of the ski and a third portion to face generally outwardly and extend generally along the width of the ski.

2. A water ski binding as defined in claim 1 wherein:

said wall surface structures comprise portions to extend generally along the length of the ski.

3. A water ski binding comprising:

a base structure to mount on the top surface of the water ski defining a series of openings in a line to extend generally along the length of the ski;

a track structure for said base structure;

a flexible boot member for the foot of the skier;

a boot member mounting structure to movably mount on said base structure for mounting said flexible boot member, said boot member mounting structure having an elongated opening therethrough to extend, along its direction of elongation, generally vertically with respect to the top surface of the ski, and said boot member mounting structure defining an opening to receive said track structure and slideably mount said boot member mounting structure on said base structure; and locking and unlocking means to selectively lock said boot member mounting structure in alternative positions generally along the length of the ski defined by said series of openings and unlock said boot member mounting structure from said positions, said locking and unlocking means including an elongated pin member to extend along said elongated boot member mounting structure opening for extension into a selected opening of said series for said locking and retraction from said opening for said unlocking.

4. A water ski binding as defined in claim 3 wherein:

said base structure defines an elongated opening to extend, along its direction of elongation, generally along the length of the ski; and said boot member mounting structure further comprises a projection to project generally downwardly with respect to the top surface of the ski into said elongated opening to slide along said opening.

5. A water ski binding, comprising:

a flexible boot member for the foot of the skier;

a first boot member mounting structure having wall surface structure to rise generally upwardly with respect to the top surface of the ski; and a second boot member mounting structure, having wall surface structure to rise generally upwardly with respect to the top surface of the ski, to slide relative to said first mounting structure and press said boot member between said wall surface structures to mount said boot member on the ski;

said wall structure of one of said boot member mounting structures including a portion to face generally inwardly and extend generally along the width of the ski; and said wall structure of said other one of said boot member mounting structures including a portion to face generally outwardly and extend generally along the width of the ski.

6. A water ski binding as defined in claim 5 wherein:

said flexible boot member has wall structure comprising rise portions to rise generally upwardly with respect to the top surface of the ski for abutment with said boot member wall surface structures, and flange portions to extend under a said mounting structure.

7. A water ski binding as defined in claim 5 wherein:

said second mounting structure is formed to support the heel of the skier.

8. A water ski binding as defined in claim 5 wherein:

said flexible boot member is formed for the heel of the skier.

9. A water ski binding as defined in claim 5 further comprising a base structure for said boot member mounting structure and boot member to mount on the top surface of the ski.

10. A water ski binding as defined in claim 9 wherein:

said base structure and said second mounting structure define openings for alignment when said second mounting structure is slid in position to mount said boot member on the ski.

11. A water ski binding as defined in claim 10 further comprising a connector to insert in said second mounting structure and base structure openings, when aligned, to hold said second mounting structure in position.

12. A water ski binding as defined in claim 9 further comprising a track structure for said base structure.

13. A water ski binding as defined in claim 12 wherein:

said second boot member mounting structure defines an opening to receive said track structure and slideably mount said second boot mounting structure on said base member.

14. A water ski binding as defined in claim 5 wherein:

said flexible boot member is formed to be held in position, when mounted, substantially solely through abutting wall surfaces of said mounting structures and boot member.

15. A water ski binding comprising:

a boot member mounting structure defining a first elongated opening to extend, along its direction of elongation, generally along the length of the ski and to open, along its direction of elongation, generally upwardly, and a second elongated opening to extend, along its direction of elongation, generally along the length of the ski and to open, along its direction of elongation, generally upwardly; and a boot member for the foot of the skier, having elongated wall structure for slidable insertion, along its direction of elongation, in said first opening to mount said boot member on said ski, and having elongated wall structure for slidable insertion, along its direction of elongation, in said second opening to mount said boot member on said ski;

said boot member mounting structure including a bar structure to mount across the entrance of said elongated openings for said boot member wall structure.

16. A water ski binding as defined in claim 15 wherein:

said openings and wall structures are formed to provide generally inverted T-shapes for said openings and wall structures on the water ski.

17. A water ski binding comprising:

a boot member mounting structure defining a first elongated opening to extend, along its direction of elongation, generally along the length of the ski, and defining a second elongated opening to extend, along its direction of elongation, generally along the length of the ski;

a boot member for the foot of the skier, having elongated wall structure for slideable insertion, along its direction of elongation, in said first opening to mount said boot member on said ski, and having elongated wall structure for slideable insertion, along its direction of elongation, in said second opening to mount said boot member on said ski;

said boot member mounting structure including a bar structure to mount across the entrances of said elongated openings for said boot member wall structure.

18. A water ski binding as defined in claim 17 wherein:

said first opening, second opening, wall structure for slideable insertion in said first opening and wall structure for slideable insertion in said second opening are each generally T-shaped.

19. A water ski binding as defined in claim 17 wherein:

said boot member mounting structure is formed to support the forefoot of the skier.

20. A water ski binding as defined in claim 17 wherein:

said boot member is flexible and formed for the forefoot of the skier.

21. A water ski binding as defined in claim 17 further comprising a base structure for said boot member mounting structure and boot member to mount on the top surface of the ski.

22. A water ski binding as defined in claim 21 further comprising a track structure for said base structure.

23. A water ski binding as defined in claim 22 wherein:

said boot member mounting structure defines an opening to receive said track structure and slideably mount said boot member mounting structure on said base member.

24. A water ski binding as defined in claim 17 wherein:

said boot member is flexible and formed to be held in position, when mounted, substantially solely through abutting wall structures of said boot member mounting structure and said boot member.

25. A water ski binding comprising:

a flexible boot member for the foot of the skier;

a first boot member mounting structure having wall surface structure to rise generally upwardly with respect to the top surface of the ski; and a second boot member mounting structure, having wall surface structure to rise generally upwardly with respect to the top surface of the ski, to slide relative to said first mounting structure and press said boot member between said wall surface structures to mount said boot member on the ski;

said wall structure of one of said boot member mounting structures including a first position to face generally inwardly and extend generally along the length of the ski toward one side of the ski, a second portion to face generally inwardly and extend generally along the length of the ski toward the other side of the ski and a third portion to face generally inwardly and extend generally along the width of the ski; and said wall structure of said other one of said boot member mounting structures including a first portion to face generally outwardly and extend generally along the length of the ski toward one side of the ski, a second portion to face generally outwardly and extend generally along the length of the ski toward the other side of the ski and a third portion to face generally outwardly and extend generally along the width of the ski.

26. A water ski binding comprising:

a base structure to mount on the top surface of the water ski defining a series of openings in a line to extend generally along the length of the ski;

a flexible boot member for the foot of the skier;

a boot member mounting structure to movably mount on said base structure for mounting said flexible boot member, having an elongated opening therethrough to extend, along its direction of elongation, generally vertically with respect to the top surface of the ski; and locking and unlocking means to selectively lock said boot member mounting structure in alternative positions generally along the length of the ski defined by said series of openings and unlock said boot member mounting structure from said positions, said locking and unlocking means including, an elongated pin member to extend along said elongated boot member mounting structure opening for extension into a selected opening of said series for said locking and retraction from said opening for said unlocking, and a cam member rotatably mounted on said pin member to act against said boot member mounting structure for said extension and retraction of said pin member.

27. A water ski binding as defined in claim 26 wherein:

said locking and unlocking means further comprises a spring member about said pin member to oppose said retraction with rotation of said cam member in one direction and to urge said extension with rotation of said cam member in the other direction.

28. A water ski binding as defined in claim 26 wherein:

said pin member comprises a flange;

the wall of said elongated opening defines a shoulder to face generally downwardly with respect to the top surface of the ski; and said spring member acts against said flange and said shoulder.

29. A water ski binding as defined in claim 26 wherein:

said elongated pin member is slidably mounted in said elongated opening.

30. A water ski binding comprising:

a foundation structure to mount on the top surface of the water ski defining a series of openings in a line to extend generally along the length of the ski;

a flexible boot member for the foot of the skier;

a boot member mounting structure to movably mount over said foundation structure for mounting said flexible boot member, and defining an opening; and locking and unlocking means to selectively lock said boot member mounting structure in alternative positions generally along the length of the ski defined by said series of openings and unlock said boot member mounting structure from said positions, said locking and unlocking means including:

an elongated pin member to extend along said boot member mounting structure opening for extension into a selected opening of said series for said locking and retraction from said opening for said unlocking, and a cam member rotatably mounted on said pin member to act against said boot member mounting structure for said extension and retraction of said pin member.

31. A water ski binding as defined in claim 30 wherein:

said elongated pin member is slideably mounted in said boot member mounting structure opening.

32. A water ski binding as defined in claim 30 wherein:

said foundation structure comprises a track structure.

33. A water ski binding as defined in claim 32 wherein:

said boot member mounting structure defines an opening to receive said track structure and slideably mount said boot member mounting structure over said foundation structure.

* * * * *